United States Patent [19]

Swanson

[11] Patent Number: 4,572,933

[45] Date of Patent: Feb. 25, 1986

[54] PRESSURE-OPERATED SWITCH FOR A HIGH-VOLTAGE INTERRUPTING MODULE

[75] Inventor: Roy T. Swanson, North Riverside, Ill.

[73] Assignee: S&C Electric Company, Chicago, Ill.

[21] Appl. No.: 525,516

[22] Filed: Aug. 22, 1983

[51] Int. Cl.[4] ..... H01H 33/06

[52] U.S. Cl. ..... 200/151; 200/144 R

[58] Field of Search ..... 200/151, 144 R, 149 A

[56] References Cited

U.S. PATENT DOCUMENTS

| | | | |
|---|---|---|---|
| 3,129,307 | 4/1964 | De Vargas | 200/151 |
| 3,586,802 | 6/1971 | Nickols et al. | 200/151 |
| 4,370,531 | 1/1983 | Tobin | 200/151 |

*Primary Examiner*—Robert S. Macon

*Attorney, Agent, or Firm*—James V. Lapacek

[57] ABSTRACT

An improved switch for a high-voltage device in which ignition of a power cartridge moves an insulative piston located in a conductive member away therefrom and into a passageway in an insulative liner. The piston moves a contact through the passageway and away from the conductive member to break an electrical interconnection between the conductive member and the movable contact, thereby opening the switch. The switch includes an insulative housing engageably surrounding, holding and fixing the relative positions of the conductive member and the liner. An interiorly relieved extension is formed at and about one end of the liner, and an exteriorly relieved region is formed in and about one end of the conductive member, whereby the region may be telescoped into and conformally engage the inside of the extension so that the conductive member and liner partially overlap along a tortuous interface so as to increase the interrupting capability of the switch by enhancing the isolation between the power cartridge and the passageway.

16 Claims, 3 Drawing Figures

12
14
16
18
20
22
23
24
26
27
48
49

22
24
26
28
30
32
36
38
40
42
44
46
48
49
50
52
54
62
64
76
78

PRESSURE-OPERATED SWITCH FOR A HIGH-VOLTAGE INTERRUPTING MODULE

BACKGROUND OF THE INVENTION

1. Field of the Invention

The present invention relates to an improved pressure-operated switch for a high-voltage interrupting module. More specifically, the present invention relates to an improvement of the switches disclosed in commonly assigned U.S. Pat. Nos. 4,342,978 issued Aug. 3, 1982 in the name of Meister, and 4,370,531 issued Jan. 25, 1983 in the name of Tobin, and in the following commonly assigned U.S. patent application: Ser. No. 179,367 filed Aug. 18, 1980 (now abandoned in favor of continuation application Ser. No. 550,201, filed Nov. 9, 1983) in the name of Jarosz and Panas; Ser. No. 179,366 filed Aug. 18, 1980 (now abandoned in favor of continuation application Ser. No. 539,396, filed Oct. 6, 1983) in the name of O'Leary, and Ser. No. 437,925 which issued Jan. 24, 1984 as U.S. Pat. No. 4,427,963, and Ser. No. 437,926, both filed Nov. 1, 1982 in the names of Jarosz and Panas.

2. Prior Art

The above-noted commonly assigned patents relate to various aspects of a pressure-operated switch and to a high-voltage interrupting module containing the switch. The switch may include a pair of contacts which are normally electrically interconnected, for example, by direct abutment therebetween or, preferably, by interconnecting them with a shearable or tearable metallic disc or membrane. In preferred embodiments of the switch, one contact is stationary, while the other is movable, although both may be movable. The contacts are separable by relative movement along a fixed line of direction to open a gap therebetween, thereby opening the switch. One of the contacts, preferably the stationary contact, contains a bore which, in conjunction with a piston or trailer positioned between the movable contact and the bore, defines a closed chamber. The chamber houses a power cartridge or similar pressure-generating device.

The switch may be in electrical shunt with a fuse, a fusible element which, as well as the switch, preferably reside within a common housing. When the switch is closed (i.e., when the contacts thereof are electrically interconnected), the resistance of the current path through the switch is much lower than resistance of the current path through the fusible element, and, accordingly, a majority of the current flowing through the module flows through the switch. Thus, the module has a very high continuous current rating. Upon opening the switch, the contacts separate and current is rapidly commutated from the switch to the fusible element where it is interrupted. Separation of the contacts is achieved by igniting the power cartridge, which evolves high pressure within the chamber. This high pressure acts against the piston and the forces produced thereby rapidly drive the piston and the movable contact away from the stationary contact, which shears the disc to break the normal electrical interconnection and open the switch. The power cartridge may be ignited in response to a trip signal produced by apparatus which senses a fault current or other overcurrent in a circuit in which the interrupting module is connected for protection thereof. Such trip-signal-producing apparatus may be that which is disclosed in commonly assigned U.S. patent application, Ser. Nos. 506,942; 506,943; and 506,944, all filed June 22, 1983 in the name of Ruta.

In specific embodiments of the switch described in the above patents and patent applications, a second stationary contact is included. When the switch is closed, the movable contact and the second stationary contact are electrically interconnected with a second shearable disc. When the power cartridge is ignited, movement of the movable contact also shears the second disc. As the movable contact moves away from the first stationary contact, it is telescoped into a bore formed in the second stationary contact. This bore may be lined with an insulative sleeve and the movable contact may be covered with an insulative sleeve, so that such telescoping results in the formation of a second gap between the movable contact and the second stationary contact.

The movable contact moves rapidly away from the first stationary contact through a passageway in an insulative liner. The piston also enters the passageway in the liner to physically isolate the moving contact and the second stationary contact from the ignition products of the power cartridge. This isolation prevents or suppresses the formation of any arc between the separating contacts and between the stationary contacts. In preferred embodiments of the switch, the stationary contacts and the liner are engageably surrounded, and have their relative positions fixed, by an insulative housing, which maintains the stationary contacts and the liner end-to-end with the bores and the passageway axially aligned.

Tests of earlier versions of the switch (such as those disclosed in the '978 and '531 patents and in the '367 and '366 applications) showed that, after the piston entered the liner, some of the ignition products of the power cartridge might, in some cases, flow along the liner-housing interface. Such flow, it was noted, might result in internal flashover of the open switch, i.e., undesired conduction there within. It is one object of the present invention to eliminate this problem.

Additionally, it was noted that high electrical stress, which might also result in internal flashover of the open switch, could occur between the regions of abutment between the liner and the stationary contacts after the switch had opened. Another object of the present invention is the elimination of such flashover.

SUMMARY OF THE INVENTION

With the above and other objects in view, the present invention contemplates an improved switch for a high-voltage device. The switch improved by the present invention is generally of the type in which ignition of a power cartridge generates high pressure ignition products which move an insulative piston, which is normally located in a first bore formed in a conductive member or first stationary contact, away therefrom and into a passageway formed in an insulative liner. Such movement of the piston moves a movable contact through the passageway and away from the conductive member or first stationary contact to break an electrical interconnection between the conductive member or first stationary contact and the movable contact, thereby opening the switch. In specific embodiments, the switch improved by the present invention also includes a second stationary contact. In this case, movement of the movable contact away from the first stationary contact is accompanied by movement of the movable contact into a bore of the second stationary contact when the switch opens. The bore or bores in the passageway are aligned preferably by an insulative housing which engageably surrounds, holds and fixes the relative positions of the conductive member and the liner or of the stationary contacts and the liner in narrower embodiments.

In the improved switch, an interiorly relieved extension is formed at or about one end of the liner and an exteriorly relieved region is formed in and about the outside of the conductive member or, in and about the stationary contacts where both are used. The relieved region is telescoped into and conformally engaged by the inside of the extension so that the conductive member or, where present, both stationary contacts and the liner partially overlap along a tortuous path.

The amount of overlap between the conductive member or the stationary contacts and the liner is sufficiently long axially of the switch to concentrate the majority of the electrical stress which is present upon opening the switch within the liner. Further, the amount of overlap between the conductive member or both stationary contacts and the liner is sufficiently long axially of the switch to prevent the flow of the ignition products along the path made up of the tortuous interface between the extension and the relieved region and the interface between the liner and the housing. Moreover, the amount of overlap between the conductive member or both stationary contacts and the liner is sufficiently long axially of the switch to increase the total creepage distance along the path made up of the interface between the relieved region and the extension and the interface between the liner and the housing. This obviates flashover of the switch along this path. Lastly, the extension is preferably configured so that the ignition products which reach the interface between the relieved region of the conductive member or first stationary contact and the extension deform the extension outwardly against the housing in a lip-seal-like manner to prevent flow of such ignition products along the liner-housing interface.

DETAILED DESCRIPTION

Figure 1:
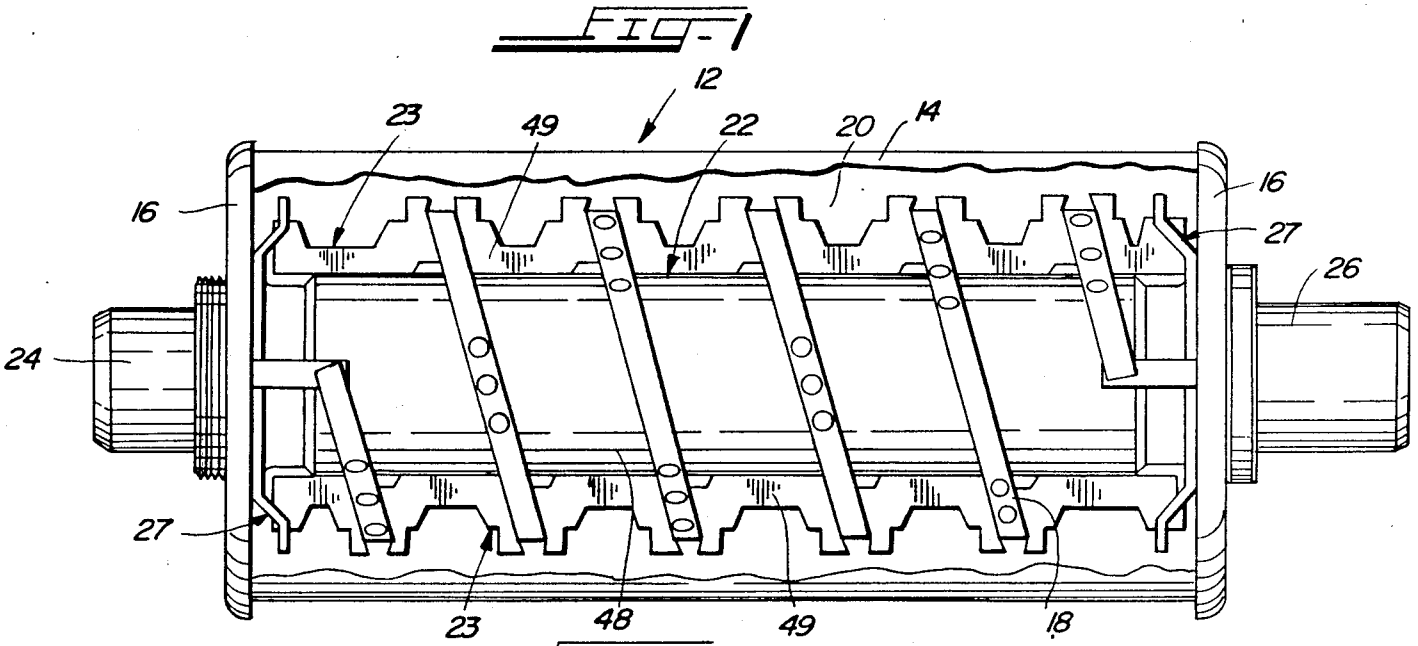
FIG. 1 is a front elevation of a portion of an interrupting module which includes an improved switch according to the present invention.

The present invention is used with an interrupting module 12. Because the module 12 is more completely described in the above U.S. patents and patent applications, it is only generally depicted in the drawing hereof and only generally described herein.

Referring to FIG. 1, the module 12 includes a generally cylindrical open-ended insulative housing 14, which is closed by end plates 16. The housing 14 and the end plates 16 surround a fusible element 18 helically wound around a central axis of the housing 14 which may be embedded in a mass of a particulate fulgurite-forming medium, such as silica sand. The medium is in intimate engagement with the fusible element 18. The fusible element 18, which may be silver or copper, and the sand 20 interrupt fault currents or other overcurrents therethrough in a current-limiting or energy-limiting manner, according to well-known principles. The fusible element 18 may be similar to those disclosed in commonly assigned U.S. Pat. No. 4,359,708, issued Nov. 16, 1982 or U.S. patent application Ser. No. 437,776 filed Oct. 29, 1982, both in the names of Jarosz and Panas.

The housing 14 also surrounds a switch 22 around which the fusible element 18 may be maintained in its helical configuration by insulative supports 23 such as those disclosed in commonly assigned U.S. patent application, Ser. No. 181,603, filed Aug. 27, 1980 in the names of Jarosz and Panas.

Figure 2:
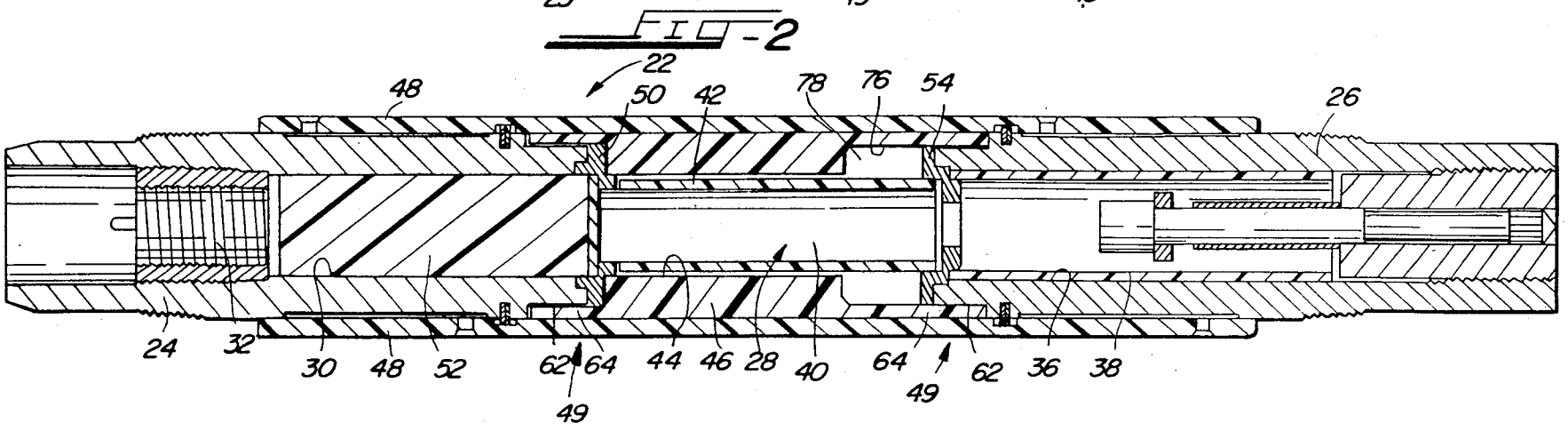
FIG. 2 is a partially sectioned elevation of a portion of FIG. 1 showing in greater detail the improved switch hereof.

The switch 22, which is improved by the present invention, may be generally constructed in accordance with the above U.S. patents and patent applications, and an example thereof is depicted in FIGS. 1 and 2. Specifically, the switch 22 includes a first conductive member 24, to which the left end plate 16 is attached and a second conductive member 26 to which the right end plate 16 is attached. The first conductive member 24 serves as a first stationary contact of the switch 22, while the second conductive member 26 serves as a second stationary contact of the switch 22. The ends of the fusible element 18 may be rendered electrically continuous with the stationary contacts 24 and 26 by facilities 27 described more fully in commonly assigned U.S. patent application Ser. No. 439,444 filed Nov. 5, 1982 in the name of Jarosz.

The switch 22 also includes a movable contact 28 (FIG. 2). Normally, the movable contact 28 is electrically continuous with both stationary contacts 24 and 26 so that a continuous low-resistance electrical path is formed between the member 24 and 26 via the movable contact 28. Because the resistance of this path is lower than the resistance of the fusible element 18, while the switch 22 is closed, as depicted in FIG. 2, the majority of the current flowing through the module 12 is normally shunted through the switch 22 and away from the fusible element 18. When the switch 22 opens, as described below, the current formerly flowing through the stationary contacts 24 and 26 and the movable contact 28 is commutated to the fusible element 18 for interruption.

As shown in FIG. 2, the first stationary contact 24 has a central bore 30. At the left end of the central bore 30, a power cartridge 32, or other pressure-generating device, is located. The second stationary contact 26 also contains a central bore 36. This bore 36 may be lined with an insulative sleeve 38.

The movable contact 28 comprises a conductive member 40 surrounded by an insulative sleeve 42. The movable contact 28 is normally located between the stationary contacts 24 and 26 and within a passageway 44 formed through an insulative liner 46 between the stationary contacts 24 and 26.

Figure 3:
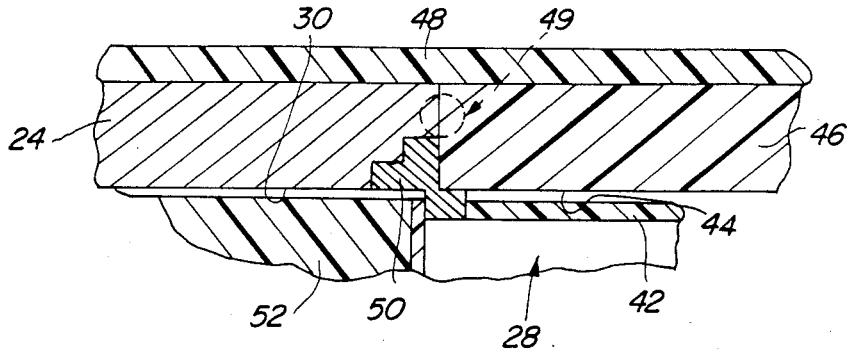
FIG. 3 is a sectioned view of a portion of the switch according to the prior art.

The stationary contacts 24 and 26, with the liner 46 therebetween, are held with the bores 30 and 36 and the passageway aligned by an insulative housing 48 which engageably surrounds the stationary contacts 24 and 26 which are affixed thereto in a convenient manner. If desired, the stationary contacts 24 and 26 may be affixed to the housing 48 pursuant to commonly assigned and filed U.S. patent application Ser. No. 524,180, filed Aug. 17, 1983 in the names of Jackson and Scherer. As shown in FIG. 1, the insulative support 23 may comprise a pair of notched fins 49, and the fusible element 18 may be helically maintained about the housing 48 by the fins 49, as described in commonly assigned U.S. patent application, Ser. No. 181,603 filed Aug. 27, 1980 in the names of Jarosz and Panas. As shown in FIG. 3, in earlier versions of the switch 22, the stationary contacts 24 and 26 and the liner 46 were cylindrical and were held in end-to-end abutment in the area denoted 49.

With the movable contact 28 occupying the position shown in FIG. 2, the conductive member 40 thereof is electrically interconnected to the stationary contact 24 by a conductive shear disc 50 or other metallic diaphragm or member, which is shearable, tearable or the like. To the left of the diaphragm 50 is located an insulative piston or trailer 52. In the normal position of the movable contact 28 shown in FIG. 2, the piston 52 normally occupies the bore 30 in the first stationary contact 24, and the movable contact 28 occupies the passageway 44 in the liner 46.

The right end of the conductive member 40 is normally electrically interconnected to the second stationary contact 26 by a shear disc 54, which may be similar to the shear disc 50. The interior of the insulative sleeve 38 is sufficiently large to receive the conductive member 40 with its insulative sleeve 42 thereon. The passageway 44 of the liner 46 can receive both the conductive member 40 with the insulative sleeve 42 thereon and the trailer 52.

In the normal condition of the module 12, as shown in FIG. 2 and as previously described, the switch 22 carries a majority of the current flowing in a protected high-voltage circuit (not shown) to which the module 12 is connected. This current flows through the stationary contacts 24 and 26, the discs 50 and 54, and the movable contact 28. Little current normally flows through the fusible element 18. Should a fault current or other overcurrent occur in the protected circuit (not shown) to which the module 12 is connected, apparatus (not shown) detects this condition and ignites the power cartridge 32. Ignition of the power cartridge 32 causes it to evolve large quantities of high-pressure gas which acts on the left end of the piston 52. The force applied to the piston 52 by the high pressure moves the piston 52 rightwardly and also moves rightwardly the movable contact 28 (i.e., the conductive member 40 with the insulative sleeve 42 thereon). Rightward movement of the piston 52 and of the movable contact 28 severs, rips or tears the discs 50 and 54, thereby breaking the electrical interconnection between the movable contact 28, on the one hand, and both stationary contacts 24 and 26, on the other hand. Two gaps are thereby opened by the switch 22. The first gap exists between the left end of the conductive member 40 and the right end of the first stationary contact 24, while the second gap exists between the right end of the conductive member 40 and the left end of the second stationary contact 26. Both gaps are electrically insulated. Specifically, the first gap is electrically insulated by the reception of the piston 52 within the passageway 44 in the liner 46. The second gap is electrically insulated by the reception of the insulative sleeve 42 within the bore 36 of the insulative sleeve 38. The reception of the piston 52 by the passageway 44 in the liner 46 is also intended to isolate the movable contact 28 and the stationary contact 26 from the ignition products of the power cartridge 32, which may contain electrically conductive, arc-promoting materials.

When the switch 22 opens, the current previously flowing therethrough is commutated to the fusible element 18. The action of the fusible element 18 and of the silica sand 20 ultimately extinguishes this current, as is well known.

After numerous tests of earlier versions of the module 12, it was found that after the switch 22 opened, the ignition products of the power cartridge 32 might, in some cases, flow from the area of abutment 49 between the liner 46 and the stationary contacts 24 and 26 along the interface between the liner 46 and the housing 48, notwithstanding a close fit between the two and the use of adhesives therebetween. Such flow can have the deleterious consequence of encouraging conduction (flashover) between the stationary contacts 24 and 26, i.e. an internal failure of the switch 22 as and after it opens. Further, with the switch 22 open, high electrical stress in the area 49 (FIG. 3) could, in some cases, result in flashover of the switch 22 between the liner 46 and the housing 48 even if no ignition product flow therebetween occurred.

To alleviate both problems, the present invention contemplates that the stationary contacts 24 and 26 and the liner 46 should assume configurations other than those shown (per FIG. 3) in the above patents and patent applications. Specifically, the stationary contacts 24 and 26 are exteriorly, annularly relieved as shown at 62 and the liner 46 is extended and internally, annularly relieved as at extension 64. The ID of the extensions 64 is the same as, or slightly smaller than, the OD of the relieved regions 62 so that the contacts 24 and 26 and the liner 46 may be telescoped together as shown in FIG. 2 and held in this relationship by the housing 48. Adhesive may be present at the interface of each relieved region 62 and its corresponding extension 64.

The described telescoping of the relieved regions 62 and the extensions 64 lengthens and renders tortuous the path any ignition products must follow in flowing along the contact-liner 24–46 interface, thereby restricting such flow. Further, the effective axial extensions 64 of the liner 46 leftwardly along the stationary contact 24 have been found to reduce electrical stress at the area 49 by requiring such stress, when the switch 22 is open, to be concentrated in the high dielectric strength material of the liner 46. This reduces the possibility of flashover across the contacts 24 and 26 of the open switch 22 via a path along the liner-housing interface 46–48. Additionally, the metal-to-metal path or creepage distance between the contacts 24 and 26 and along the liner-housing 46–58 interface of the open switch 22 is also increased in length—that is, to the length of the tortuous path to aid in the prevention of flashover along the liner-housing interface 46–48. Lastly, any ignition products which manage to reside at the interface between the extensions 64 and the relieved regions 62 tend to deform the extensions 64 outwardly against the interior of the housing 48. This lip-seal-like action of the extensions 64 aids the flow-restricting function of the tortuous path along the interface 62–64.

Similar structure may be included at the right of the liner 46 and at the left of the second stationary contact 26 to reduce electrical stress at the junction thereof and to further increase the creepage distance along the liner-housing 46–48 interface.

The above structure may be used with the invention of commonly assigned and filed U.S. patent application Ser. Nos. 524,181 and 525,205, filed Aug. 17, 1983 and Aug. 22, 1983, respectively in the name of Jackson and Swanson, respectively. These latter inventions would have the effect of minimizing the quantity of ignition products available for flowing along the interface 62–64.

As set forth in '926 application, the bore 44 of the liner 46 may be relieved, undercut or diametrically increased in size, as shown at 76. This provides a relief cavity or volume 78. Should interruption of a fault current or other overcurrent by the fusible element 18 generate sufficient heat to cause undue expansion of the liner 46 or the piston 52, the relief cavity or volume 78 provides a space into which the material of these elements can expand. Such expansion into the relief cavity or volume 78 prevents outward forces or pressure from being applied to the housing 14, to the end plates 16, and to the members 24 and 26, thus ensuring that the module 12 remains integral during and following operation thereof.

With these advantages and features in mind, it should be apparent that various changes, alterations, and modifications may be made to the preferred embodiment of the present invention as described herein, without departing from the spirit and scope of the present invention as defined in the appended claims.

I claim:

1. An improved switch for a high-voltage device; the switch being of the type in which ignition of a power cartridge generates high pressure ignition products which move an insulative piston, which is normally located in a first bore formed in a conductive member, away therefrom and into a passageway formed in an insulative liner, such movement of the piston moving a movable contact through the passageway and away from the conductive member to break an electrical interconnection between the conductive member and the movable contact, thereby opening the switch; the bore and the passageway being aligned; an insulative housing engageably surrounding, holding and fixing the relative positions of the conductive member and the liner; wherein the improvement comprises:

an interiorly relieved extension formed at and about one end of the liner, and an exteriorly relieved region formed in and about the outside of the conductive member at one end thereof, the region being telescoped into and conformally engaging the inside of the extension so that the conductive member and the liner partially overlap along a tortuous interface.

2. An improved switch as in claim 1, wherein the amount of overlap between the conductive member and the liner is sufficiently long axially of the switch to concentrate the majority of the electrical stress, which is present upon opening the switch, within the liner, thereby obviating flashover of the open switch.

3. An improved switch as in claim 2, wherein the overlap and the thickness of the extension are sufficient to obviate flashover exteriorly of the housing.

4. An improved switch as in claim 2, wherein the overlap and the thickness of the extension are sufficient to obviate flashover along the housing-liner interface.

5. An improved switch as in claim 1, wherein the amount of overlap between the conductive member and the liner is sufficiently long axially of the switch to prevent the flow of the ignition products along the path made up of the tortuous interface between the extension and the relieved region and the interface between the liner and the housing.

6. An improved switch as in claim 1, wherein the amount of overlap between the conductive member and the liner is sufficiently long axially of the switch to increase the total creepage distance along the path made up of the interface between the relieved region and the extension and the interface between the liner and the housing, whereby flashover of the switch along such path is obviated.

7. An improved switch as in claim 1, wherein the extension is configured so that the ignition products which reach the interface between the relieved region and the extension deform the extension outwardly against the housing in a lip-seal-like manner to prevent flow of such ignition product along the liner-housing interface.

8. An improved switch as in claim 1, wherein the amount of overlap between the conductive member and the liner is sufficiently long axially of the switch to (a) concentrate the majority of the electrical stress, which is present upon opening the switch, within the liner, thereby obviating flashover of the open switch, (b) to prevent the flow of the ignition products along the path made up of the tortuous interface between the extension and the relieved region and the interface between the liner and the housing, and (c) to increase the total creepage distance along the path made up of the interfaces between the relieved region and the extension and the interface between the liner and the housing, whereby flashover of the switch along such path is obviated; and wherein the extension is configured so that ignition products which reach the interface between the relieved region and the extension deform the extension outwardly against the housing in a lip-seal-like manner to prevent flow of such ignition products along the liner-housing interface.

9. An improved switch for a high-voltage device, the switch being of the type in which ignition of a power cartridge generates high pressure ignition products which move an insulative piston, which is normally located in a first bore formed in a first stationary contact, away therefrom and into a passageway formed in an insulative liner, such movement of the piston moving a movable contact through the passageway and away from the first stationary contact and into a bore of a second stationary contact to break electrical interconnections between the stationary contacts and the movable contact, thereby opening the switch; the bores being aligned, an insulative housing engageably surrounding, holding and fixing the relative positions of the stationary contacts and the liner; wherein the improvement comprises:

an interiorly relieved extension formed at and about both ends of the liner, and an exteriorly relieved region of reduced diameter formed in and about the outside of the stationary contacts at one end thereof, the regions being respectively telescoped into and conformally engaging the inside of the extensions so that the stationary contacts and the liner partially overlap along tortuous interfaces.

10. An improved switch as in claim 9, wherein the amount of overlap between the stationary contacts and the liner is sufficiently long axially of the switch to concentrate the majority of the electrical stress between the stationary contacts, which stress is present upon opening the switch, within the liner, thereby obviating flashover of the open switch.

11. An improved switch as in claim 10, wherein the overlaps and the thickness of the extensions are sufficient to obviate flashover exteriorly of the housing.

12. An improved switch as in claim 10, wherein the overlaps and the thickness of the extensions are sufficient to obviate flashover along the housing-liner interface.

13. An improved switch as in claim 9, wherein the amount of overlap between the first stationary contact and the liner is sufficiently long axially of the switch to prevent the flow of the ignition products long the path between the stationary contacts and made up of the tortuous interface between the extensions and the relieved regions and the interface between the liner and the housing.

14. An improved switch as in claim 9, wherein the amount of overlap between the stationary contacts and the liner is sufficiently long axially of the switch to increase the total creepage distance along the path between the stationary contacts made up of the interface between the relieved regions and the extensions and the interface between the liner and the housing, whereby flashover of the switch along such path is obviated.

15. An improved switch as in claim 9, wherein the extension overlapping the relieved region of the first stationary contact is configured so that the ignition products which reach the interface between such relieved region and extensions deform the extension outwardly against the housing in a lip-seal-like manner to prevent flow of such ignition products along the liner-housing interface.

16. An improved switch as in claim 9, wherein the amount of overlap between the stationary contacts and the liner is sufficiently long axially of the switch to (a) concentrate the majority of the electrical stess, which is present between the stationary contacts upon opening the switch, within the liner, thereby obviating flashover of the open switch, (b) to prevent the flow of the ignition products along the path made up of the tortuous interfaces between the extensions and the relieved regions and the interface between the liner and the housing, and (c) to increase the total creepage distance between the stationary contacts along the path made up of the interfaces between the relieved regions and the extensions and the interface between the liner and the housing, whereby flashover of the switch along such path is obviated; and wherein the extension surrounding the relieved region of the first stationary contact is configured so that ignition products which reach the interface between such relieved region and extension deform the extension outwardly against the housing in a lip-seal-like manner to prevent flow of such ignition products along the liner-housing interface.

* * * * *